US011471748B2

(12) United States Patent
Kwiatkowski

(10) Patent No.: US 11,471,748 B2
(45) Date of Patent: Oct. 18, 2022

(54) BOWLING GLOVE

(71) Applicant: Robert Kwiatkowski, Niskayuna, NY (US)

(72) Inventor: Robert Kwiatkowski, Niskayuna, NY (US)

( * ) Notice: Subject to any disclaimer, the term of this patent is extended or adjusted under 35 U.S.C. 154(b) by 63 days.

(21) Appl. No.: 16/545,332

(22) Filed: Aug. 20, 2019

(65) Prior Publication Data

US 2021/0052969 A1 Feb. 25, 2021

(51) Int. Cl.
*A63B 71/14* (2006.01)

(52) U.S. Cl.
CPC ..... *A63B 71/148* (2013.01)

(58) Field of Classification Search
CPC ..... A63B 71/141; A63B 71/148; A63B 71/14; A63B 71/02; A41D 19/0024; A41D 19/01588; A41D 19/01594; A41D 19/01558; A41D 19/00
USPC ..... 2/160, 161.1
See application file for complete search history.

(56) References Cited

U.S. PATENT DOCUMENTS 2,738,190 A * 3/1956 Tureaud ..... A63B 71/148 473/59
2,837,745 A * 6/1958 Nelson ..... A41D 19/01594 2/161.6
2,949,610 A * 8/1960 Lutsky ..... A63D 5/00 2/16
3,031,680 A * 5/1962 Compiano ..... A63B 71/148 2/159
3,098,654 A * 7/1963 Larsen ..... A63D 5/00 473/60
3,123,832 A * 3/1964 Kubik ..... A63B 71/148 2/161.1
3,203,006 A * 8/1965 Shirey ..... A63B 71/148 2/161.1
3,208,749 A * 9/1965 Skuse ..... A63D 5/00 473/60
3,214,167 A * 10/1965 Pell ..... A63D 5/00 473/60
3,236,553 A * 2/1966 Shrier ..... A41D 19/01547 294/25
3,333,850 A * 8/1967 Miller ..... A63B 71/148 473/60
3,413,000 A * 11/1968 Alkonis ..... A63B 71/148 473/61
3,421,160 A * 1/1969 Domenico ..... A63B 71/148 2/159
3,438,630 A * 4/1969 Joseph ..... A63D 5/00 473/60

(Continued)

*Primary Examiner* — Heather Mangine
*Assistant Examiner* — Raquel M. Weis
(74) *Attorney, Agent, or Firm* — Schmeiser, Olsen & Watts, LLP

(57) ABSTRACT

A bowling glove includes a glove body including a palm portion configured to cover a palm of a wearer, and a protruding nub securably attachable to the palm portion of the glove body such that the location of the protruding nub relative to the palm portion of the glove body is selectively adjustable. The protruding nub is configured to protrude from the palm portion of the glove body, and the protruding nub is configured to be received by a bore of a bowling ball. A method of manufacturing the bowling glove and a method of fitting a bowling ball to the bowling glove are further described.

13 Claims, 11 Drawing Sheets

(56) References Cited

U.S. PATENT DOCUMENTS 3,583,704 A * 6/1971 Callanan ..... A63B 71/148 473/62
3,595,575 A * 7/1971 Gooch ..... A63D 5/00 473/61
3,606,319 A * 9/1971 Borden ..... A63D 5/00 473/61
3,672,673 A * 6/1972 Hicks ..... A63D 5/00 473/60
4,496,151 A * 1/1985 Tureaud ..... A63B 69/0046 473/59
4,552,359 A * 11/1985 McDonald ..... A63B 69/0046 473/61
4,577,625 A * 3/1986 Lohati ..... A61H 15/0092 601/128
4,589,146 A * 5/1986 Taylor ..... A41D 19/01547 2/161.3
4,608,720 A * 9/1986 Purin ..... A63B 69/0046 2/161.1
4,877,242 A * 10/1989 James ..... A63B 71/148 473/46
4,938,487 A * 7/1990 Ponsart ..... A63B 69/0046 2/160
5,330,391 A * 7/1994 Mitchell ..... A63B 71/148 2/16
5,435,007 A * 7/1995 Kalvestran ..... A41D 13/088 2/16
5,611,735 A * 3/1997 Jackson ..... A63B 69/0046 2/161.1
5,853,210 A * 12/1998 Robinson ..... A61F 5/0118 294/25
5,873,788 A * 2/1999 Hoffman ..... A63B 69/0059 473/205
6,055,669 A * 5/2000 Albert ..... A63B 71/148 2/161.1
6,244,639 B1 * 6/2001 Storck ..... B63C 9/32 294/25
6,374,417 B1 * 4/2002 Stagnitta ..... A41D 19/01529 2/16
6,427,248 B1 * 8/2002 Albert ..... A41D 19/01558 2/161.1
8,370,966 B2 * 2/2013 Hendon ..... A41D 19/01547 2/160
10,383,378 B1 * 8/2019 Ptah ..... A61H 7/007
2004/0199978 A1 * 10/2004 Cass ..... A63B 71/148 2/161.3
2008/0078010 A1 * 4/2008 Micheloni ..... A63B 71/148 2/160
2012/0052966 A1 * 3/2012 Collinsworth ..... A63B 71/148 473/60
2015/0282539 A1 * 10/2015 Darby ..... A63B 71/148 2/160
2016/0287472 A1 * 10/2016 Starzhynskaya ..... A61H 39/04

* cited by examiner

BOWLING GLOVE

FIELD OF TECHNOLOGY

The subject matter disclosed herein relates generally to bowling gloves. More particularly, the subject matter relates to bowling gloves adapted for integration with bowling balls, methods of manufacturing thereof, and methods of fitting a bowling ball to a bowling glove.

BACKGROUND

Bowling is a recreation activity enjoyed by people of all ages. It is known for bowlers to employ the use of bowling gloves. These gloves help to enhance the grip between the hand of the bowler and the bowling ball. Bowling gloves typically cover some of the fingers, while leaving other fingers as open finger stalls. For example, the typical bowling glove includes covering the palm of the bowler's hand along with the index finger and little fingers, while leaving the thumb, middle finger and ring finger at least partially exposed.

In addition to grip enhancement, bowling gloves further help protect the hand from wear caused by participation in the sport. However, there are certain hand injuries that remain prevalent that are not addressed by the wearing of gloves. For example, bowler's thumb is an injury that occurs to the thumb of a bowler when the bowler uses the thumb to spin the bowling ball during a throw. Bowler's thumb causes chronic irritation, tenderness and pain, and may even create a localized mass in the thumb.

Perhaps because of these medical issues, or perhaps for comfort and the ability to more easily spin the ball, it is increasingly becoming more popular amongst bowlers to not utilize the thumb within the bowling ball thumb hole during a throw. Referred to as "thumb out" or "no-thumb" bowling, this technique can prevent injury. However, for many bowlers, this technique sacrifices the grip associated with utilizing the thumb within the thumb hole.

Thus, an improved bowling glove adapted for integration with bowling balls, and methods of installation and manufacture thereof, which accounts for user positioning preference, would be well received in the art.

SUMMARY

A first aspect relates to a bowling glove comprises: a glove body including a palm portion configured to cover a palm of a wearer; and a protruding nub securably attachable to the palm portion of the glove body such that the location of the protruding nub relative to the palm portion of the glove body is selectively adjustable, wherein the protruding nub is configured to protrude from the palm portion of the glove body, and wherein the protruding nub is configured to be received by a bore of a bowling ball.

A second aspect relates to a method of manufacturing a bowling glove comprises: providing a glove body including a palm portion configured to cover a palm of a wearer, the palm portion including at least one palm attachment location; aligning the at least one opening with at least one of the plurality of attachment locations of the palm portion of the glove body, the at least one opening configured to receive a threaded peg; and fashioning a protruding nub securably attachable to the palm portion of the glove body at the at least one palm attachment location such that the location of the protruding nub relative to the palm portion of the glove body is selectively adjustable, wherein the protruding nub is configured to protrude from the palm portion of the glove body, and wherein the protruding nub is configured to be received by a bore of a bowling ball.

A third aspect relates to a method of fitting a bowling ball to a bowling glove comprising: providing a bowling glove comprising: a glove body including a palm portion configured to cover a palm of a wearer, the palm portion including at least one palm attachment location; a protruding nub securably attached to the palm portion of the glove body at the at least one palm attachment location, wherein the protruding nub is configured to protrude from the palm portion of the glove body; providing a bowling ball having a spherical outer surface; determining a location on the spherical outer surface for drilling a bore configured to receive the protruding nub; and drilling the hole configured to receive the protruding nub, the dimensions of the bore corresponding to the dimensions of the protruding nub.

BRIEF DESCRIPTION OF THE DRAWINGS

The subject matter disclosed herein is distinctly claimed in the claims at the conclusion of the specification. The foregoing and other features and advantages are apparent from the following detailed description taken in conjunction with the accompanying drawings in which:

DETAILED DESCRIPTION

A detailed description of the hereinafter described embodiments of the disclosed apparatus and method are presented herein by way of exemplification and not limitation with reference to the Figures.

Figure 1:
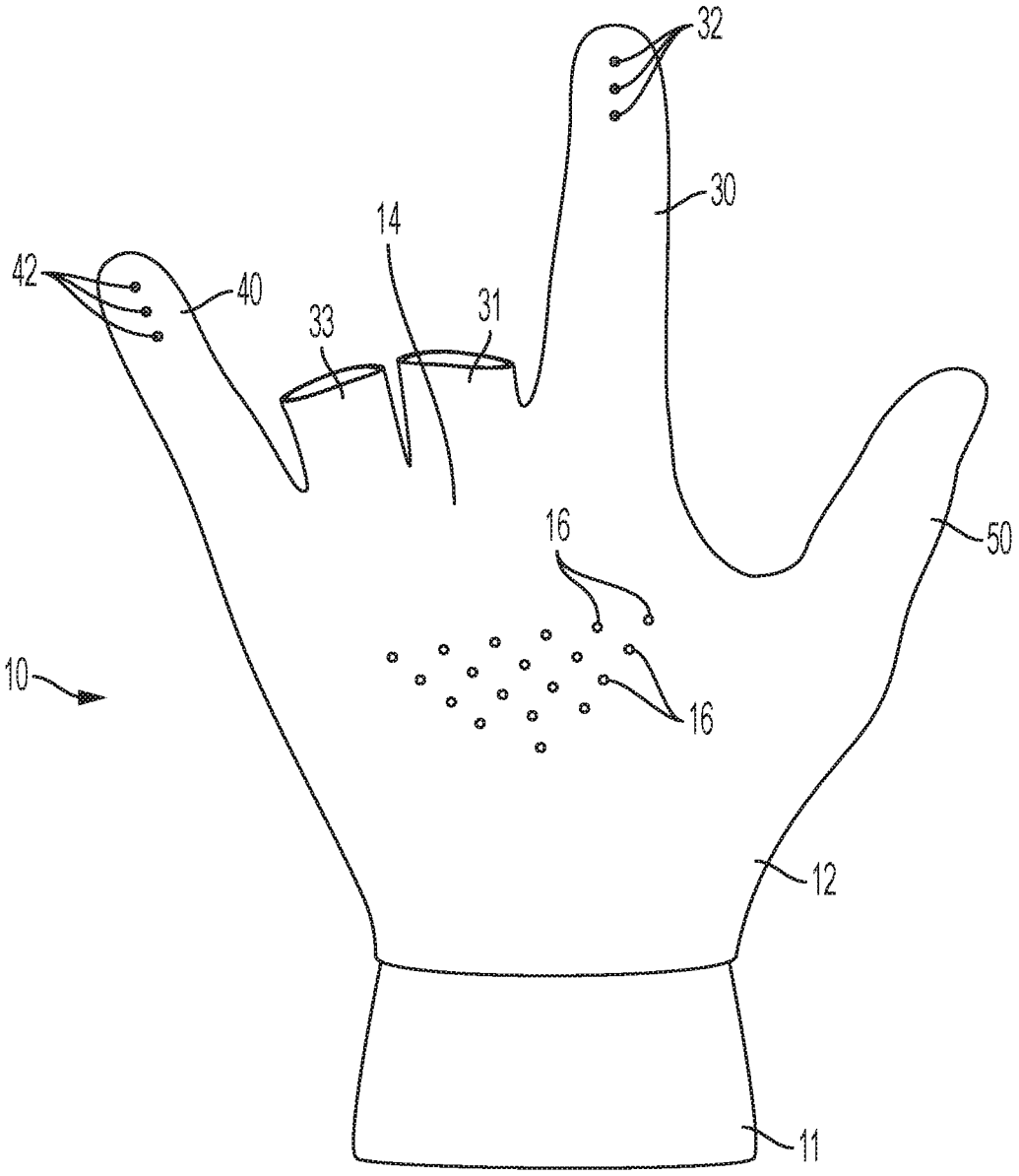
FIG. 1 depicts a perspective view of a bowling glove, in accordance with one embodiment.

FIG. 1 depicts a perspective view of a bowling glove 10 in accordance with one embodiment. The bowling glove 10 includes a glove body 12 having a palm portion 14. Extending from the palm portion 14 includes an index finger cover 30, a partial middle finger stall 31, a partial ring finger stall 33, a pinky finger cover 40 and a thumb cover 50. While the partial stalls 31, 33 are shown so that a bowler may expose the two fingers typically inserted into the finger holes of a bowling ball, it should be understood that the invention is not limited in this respect. In other contemplated embodiments, any of the finger locations may be partial stalls or full covers depending on the preference of a bowler without departing from the scope of the invention. Further, the thumb cover 50 is shown as a full cover in the embodiment shown. This may be particularly advantageous in embodiments where the bowling glove 10 is particularly configured for "no thumb" or "thumb out" bowling.

The palm portion 14 of the glove body 12 is shown having a plurality of palm attachment locations 16. The plurality of palm attachment locations 16 comprise openings or holes disposed within the glove body 12. The openings or holes form an array of openings or holes within the palm portion 14. This array of openings may be configured to provide various locations upon which to attach a nub, as described herein below.

The index finger cover 30 includes a plurality of index finger attachment locations 32 which comprise openings or holes disposed within the index finger cover 30 proximate the tip thereof such that the openings would be located at the distal phalanx of the finger when the bowling glove 10 is worn. In particular, the index finger attachment locations 32 are three separate openings disposed in a line along the middle of the index finger cover 30. Likewise, the pinky finger cover 40 includes a plurality of pinky finger attachment locations 32 which comprise openings or holes disposed within the pinky finger cover 40 proximate the tip thereof such that the openings would be located at the distal phalanx of the finger when the bowling glove 10 is worn. In particular, the pinky finger attachment locations 42 are three separate openings disposed in a line along the middle of the pinky finger cover 30.

A wrist band 11 extends from the palm portion14 of the glove body 12. The bowling glove 10 may include any additional suitable features. For example, the bowling glove may be made of a material that is configured to grip the surface of a bowling ball. Varying amounts of friction between the glove and a bowling ball surface may be employed. Further, the bowling glove 10 may be provided in varying sizes to accommodate varying hand sizes. Providing custom gloves particularly designed for the dimensions of a given bowlers hands are also contemplated.

Figure 2:
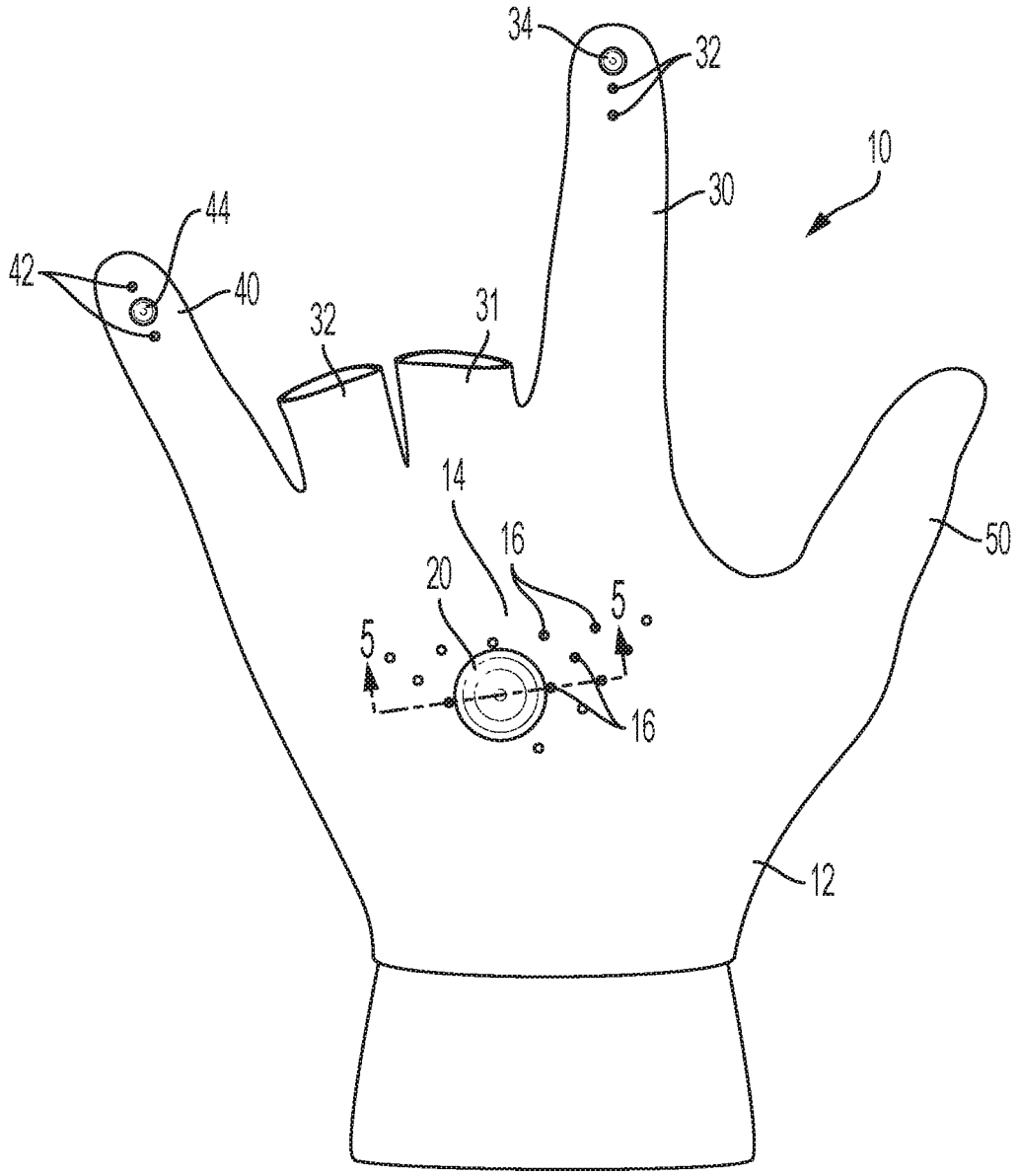
FIG. 2 depicts a perspective view of the bowling glove of FIG. 1 with attached protruding nubs, in accordance with one embodiment.

FIG. 2 depicts a perspective view of the bowling glove 10 with attached protruding nubs 20, 34, 44, in accordance with one embodiment. In particular, a first protruding nub 20 is shown attached to one of the palm attachment locations 16 in the palm portion 14 of the bowling glove 10. A second protruding nub 34 is attached to a top one of the index finger attachment locations 32 in the index finger cover 30. A third protruding nub 44 is attached to a middle one of the pinky finger attachment locations 42 in the pinky finger cover 40. As shown, the protruding nubs 20, 34, 44 may be attachable to any of the various attachment locations 16, 32, 42 shown. Further, as shown the protruding nubs 20, 34, 44 may each be dimensionally different relative to each other. For example, the first protruding nub 20 in the palm portion 14 may be larger than each of the second and third protruding nubs 34, 44 in the fingers. While each of the second and third protruding nubs 34, 44 may be the same size, in other embodiments each nub may be separately and independently sized. Thus, the third protruding nub 44 at the pinky finger cover 40 may be smaller than the second protruding nub 34 at the index finger cover 30. Varying sizes are contemplated and may be customized according to a bowler's preference.

Whatever the embodiment, each of the protruding nubs 20, 34, 44 may be attachable to the glove in a selectively adjustable, changeable, or adaptable manner. It has been found that adjustability of attachment of the nub is critical because the adjustability allows the bowling glove 10 to accommodate the physiology and preferences of each individual bowler. As shown, this may be accomplished by the various attachment locations 16, 32, 42 provided for in each of the palm portion 14, the index finger cover 30 and the pinky finger cover 40. However, other embodiments are contemplated that may provide for selective adjustability, changeability or adaptability of the nub attachment. For example, embodiments may employ strong hook and loop material that integrates between the nub and the glove and allows for adjustability in the attachment location of each of the nubs 20, 34, 44 relative to the positions on the bowling glove 10. Other embodiments may remove portions of the glove body 12 completely in order to expose an underlying support structure (described herein below) that provides for various attachment locations. Still other embodiments may include a construction having a plurality of sockets and spaced apart on a surface of the palm portion 14, each socket including a reusable lock for locking the nub attachment in the socket through rotation of the nub attachment within the socket in a manner similar to golf shoe spikes and the like. The sockets may be configured with a deformable tongues located radially on the underbase of the nub for engaging and locking with corresponding surfaces of the socket. Whatever the embodiment, the protruding nubs 20, 34, 44 may be selectively adjustable and/or securably attachable to the glove body 10.

While the bowling glove 10 may be particularly configured for "thumb out" or "no thumb" bowling, other embodiments are contemplated. For example, other embodiments of the invention may include a bowling glove configured for thumb-in bowling. Such an embodiment may not require the attachment locations having adjustable grip nubs located in the fully covered fingers. For example, only the second and third protruding nubs 34, 44 may be employed in embodiments configured for thumb-in bowling.

Figure 3A:
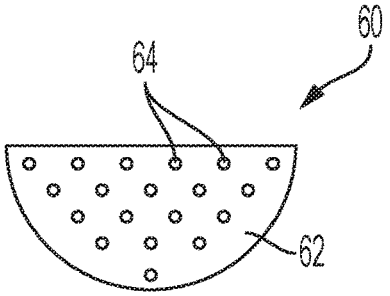
FIG. 3A depicts a perspective view of a support structure of the bowling glove of FIGS. 1 and 2, in accordance with one embodiment.

FIG. 3A depicts a perspective view of a support structure 60 of the bowling glove 10, in accordance with one embodiment. The support structure 60 includes a main body 62 that may be permanently affixable to the palm portion 14 of the glove body 12. For example, the support structure 60 may be sewn, glued, adhered or otherwise attached to the glove body 12 using any attachment means. The support structure 60 may be made of a material that is more rigid than the glove body 12. For example, the glove body 12 may be made of a fabric material, while the support structure 60 may be made of a plastic or composite material. The support structure 60 is shown with a plurality of openings 64. These openings 64 may each correspond to and align with the plurality of attachment locations 16 in the palm portion 14 of the glove body 12 when the support structure 60 is attached to the glove body 12. Like the openings defining the plurality of attachment locations 16, the openings 64 of the support structure 60 may each be configured to receive a threaded peg of the protruding nub 20, described herein below. The support structure 60 may be rigid enough to provide structural support to retain the protruding nub 20 in place during use. However, the support structure 60 may also include a sufficient degree of flexibility to allow for the support structure to contour to the hand of a wear and flex during use in a manner that prevents discomfort while throwing.

Figure 3B:
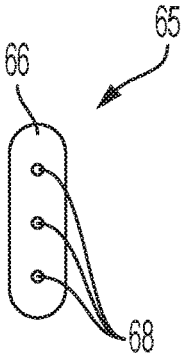
FIG. 3B depicts a perspective view of another support structure of the bowling glove of FIGS. 1 and 2, in accordance with one embodiment.

FIG. 3B depicts a perspective view of another support structure 65 of the bowling glove of FIGS. 1 and 2, in accordance with one embodiment. The support structure 65 includes a main body 65 that may be permanently affixable to the glove body 12. For example, the support structure 60 may be sewn, glued, adhered or otherwise attached to the glove body 12 using any attachment means. The support structure 65 may be permanently affixable to either of the pinky finger cover 40 or the index finger cover 30 of the glove body 12. Like the support structure 60, the support structure 65 may be made of a material that is more rigid than the glove body 12, such as a plastic or composite material. The support structure 65 is shown with a plurality of openings 68 fashioned in a line array. These openings 68 may each correspond to and align with the plurality of attachment locations 32, 42 in either of the index finger cover 30 or the pinky finger cover 40 of the glove body 12 when the support structure 65 is attached to the glove body 12. Like the openings defining the plurality of attachment locations 16, the openings 68 of the support structure 65 may each be configured to receive a threaded peg of one of the protruding nubs 34, 44, described herein below. The support structure 65 may be rigid enough to provide structural support to retain the protruding nubs 34, 44 in place during use. However, the support structure 65 may also include a sufficient degree of flexibility to allow for the support structure to contour to the finger of a wear and flex during use in a manner that prevents discomfort while throwing.

As shown in FIGS. 3A and 3B, support structures 60, 65 of varying shapes are contemplated. For example, the support structure 60 includes an array of openings 64 spaced across a half-circular shape. The support structure 60 includes an array of openings 68 in a line array. Various other shapes of the support structures 60, 65 having opening locations disposed at various locations thereon are also contemplated. In some embodiments, the openings 64, 68 of the support structures 60, 65 may be threaded in order to receive male threads of a peg of the nub.

Figure 3C:
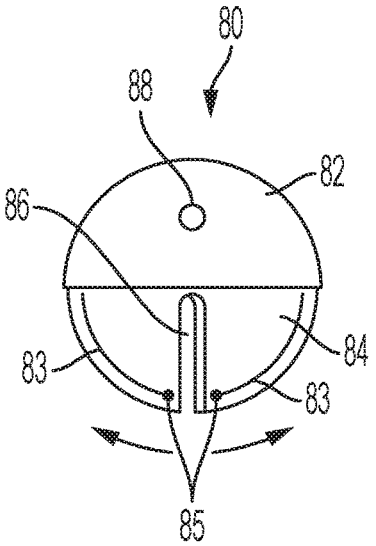
FIG. 3C depicts an alternative support structure, in accordance with one embodiment.

FIG. 3C depicts an alternative support structure 80, in accordance with one embodiment. The support structure 80 shown may be an alternative embodiment that replaces the support structure 60 described hereinabove. The support structure 80 may include an outer housing 82, an inner body 84, and an opening of the inner body 86. The inner body 84 may include a projection 83 extending about its circumference that is keyed to a respective channel within the opening of the outer housing 82. This channel and projection configuration may maintain attachment of the inner body 84 and the outer housing 86 and provide for rotation of the inner body 84 about the outer housing 82. Projecting stops 85 may be provided at the endpoints of the projection 83 proximate both sides of the opening of the inner body 86. The projecting stops 85 may prevent rotation of the inner body 84 with respect to the outer housing 82 past these stop points. A location in the outer housing 82 may further include a locking mechanism 88 for locking the position of the inner body 84 relative to the outer housing 82. In practice, rotation of the inner body 84 relative to the outer housing 82 may provide for the opening of the inner body 86 to occupy any position within the half-circular shape of the exposed inner body 84. This may allow the accommodation for the selectively adjustable attachment of the nub in any location within the half circular shape. Once the proper position is found, a wearer may press the locking mechanism which may deploy a pin (not shown) for locking the position of the inner body 84 relative to the outer housing 82. The support structure 80 may be made of similar materials as the support structures 60, 65. Further, in this embodiment, the outer housing 82 may be affixed to the glove body 12 while the inner body 84 may be allowed to move relative to the glove body 12.

Figure 4A:
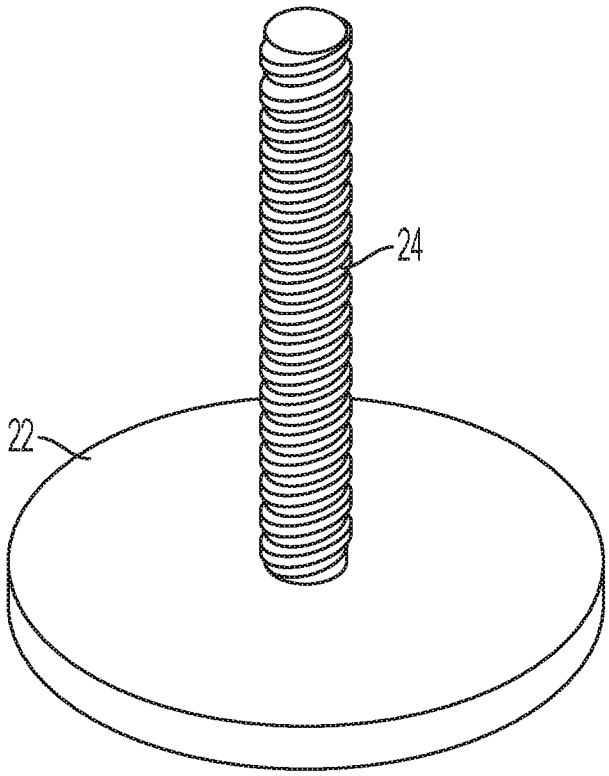
FIG. 4A depicts a perspective view of a base portion of one of the protruding nubs of FIG. 2, in accordance with one embodiment.

FIG. 4A depicts a perspective view of a base portion 22 of one of the protruding nubs 20 of FIG. 2, in accordance with one embodiment. The base portion 22 includes a circular base structure. This shape, thickness or other dimensional properties of the base portion 22 are not intended to limit the scope of the invention and other shapes, thickness and dimensional properties are contemplated. The base portion 22 may be made of a rigid or semi-rigid material such as a plastic, metal or composite. Extending from the base portion is a threaded peg 24. The threaded peg 24 may be permanently attached to the base portion 22. The threaded peg 24 may be made of metal in one exemplary embodiment. The height of the threaded peg 24 may be sufficient to allow the threaded peg 24 to extend through the layers of the bowling glove 10 and further attach to a nub body.

Figure 4B:
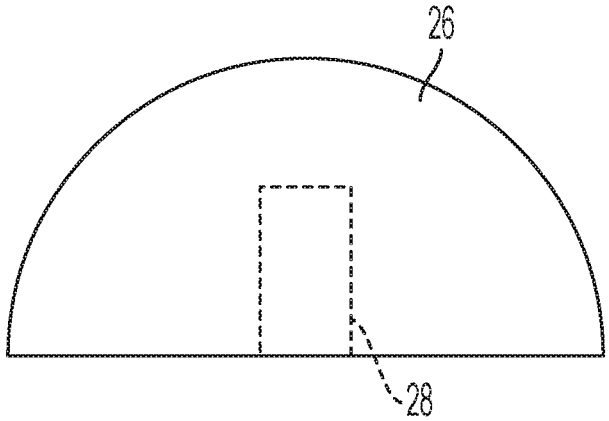
FIG. 4B depicts a perspective view of a nub body of one of the protruding nubs of FIG. 2, in accordance with one embodiment.

FIG. 4B depicts a perspective view of a nub body 26 of one of the protruding nubs 20 of FIG. 2, in accordance with one embodiment. The nub body 26 includes a threaded hole 28 extending from the middle of the underside of the nub body 26 configured to receive the threaded peg 24 of the base portion 22. The base portion 22 and nub body 26 shown in FIGS. 4A and 4B may represent any of the nubs 20, 34, 44 in the embodiment shown in FIG. 2. Thus, each of the nubs 20, 34, 44 may include a circular base portion 22, extending threaded peg 24 and attachable nub body 26.

Figure 5:
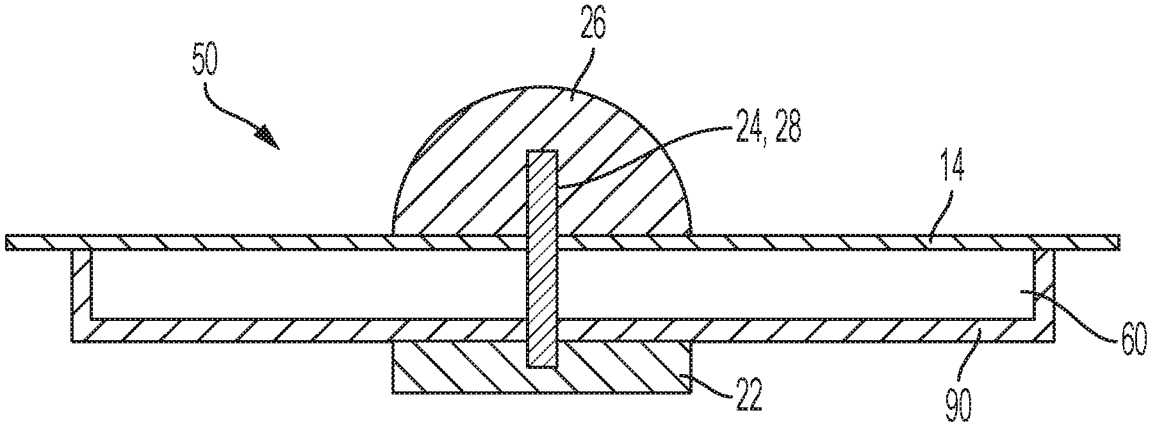
FIG. 5 depicts a side cutaway view of the bowling glove of FIG. 2, taken at arrows 5—5, in accordance with one embodiment.

FIG. 5 depicts a side cutaway view of the bowling glove 10 of FIG. 2, taken at arrows 5 5, in accordance with one embodiment. As shown, the nub 20 includes the circular base portion 22 and the threaded peg 24 extending through three glove layers: a cloth layer 90 that is stitched to the exterior layer of the palm portion 14 of the glove body 12, sandwiching the support structure 60 layer there-between. The cloth layer 90 may be configured to touch the skin of a wearer and may be made of a softer, non-functional material. The cloth layer 90 may still be inelastic enough to maintain the position of the support structure 60 relative to the glove body 12 when stitched therein. The cloth layer 90 may include openings (not shown) that are also spaced apart to correspond with the openings 64 in the support structure 60 and the attachment locations 16 (shown as openings) in the palm portion 14 of the glove body 12. In order to help maintain positional integrity, the surfaces of the various layers 90, 60, 14 may be attached to each other with glue, tape, or other adhering structure. While FIG. 5 shows a cutaway view taken at arrows 5—5, it should be understood that this same layered structure may be applied to the nubs 34, 44 in the fingers. Further, this same layered structure may be applied substituting the support structure 80 for the support structure 60.

In still other embodiments, the bowling glove 10 may include one or more straps (not shown) attaching to the edges of the support structure 60 and wrapping around the glove body 12. The straps may partially wrap around the glove body 12 or completely wrap around the glove body 12, attaching to opposite edges of the support structure 60 at each end of the strap. In other embodiments, the support structure 60 may include one or more openings through which the straps may be threaded. The openings may be on the edges or on the back side of the support structure 60. The straps may help maintain the position of the support structure 60 with respect to the glove body 12. One or more straps may be deployed in any manner to further support the support structure 60 and maintain positional integrity of the nub 20 relative to the glove body 12 during use.

Figure 6:
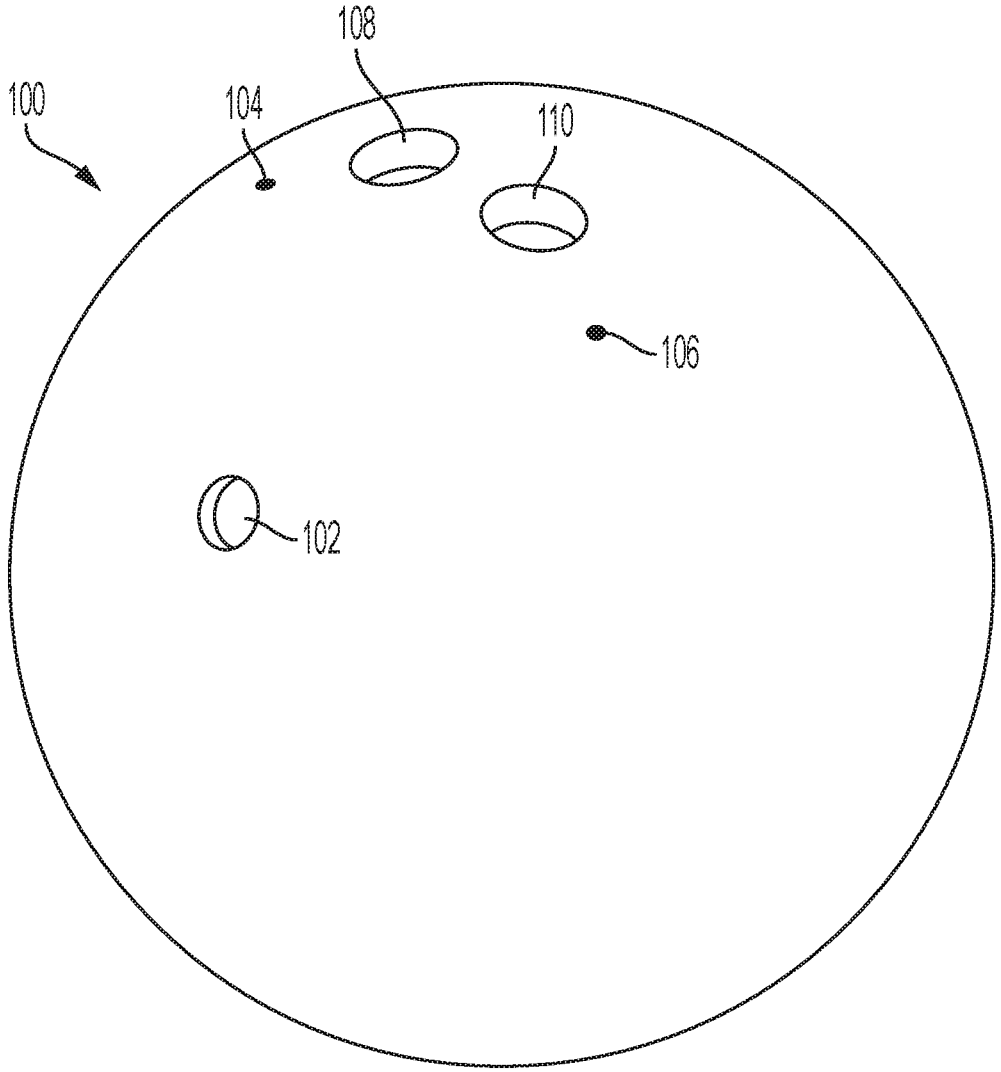
FIG. 6 depicts a bowling ball, in accordance with one embodiment.

FIG. 6 depicts a bowling ball 100, in accordance with one embodiment. The bowling ball 100 has been equipped with a first bore 102 corresponding in size and shape to the first protruding nub 20. The first bore 102 may be bored using a tool that corresponds to the shape of the first protruding nub 20, as described herein below. Alternatively, the first bore 102 may be bored in a standard manner, then modified with an insert that is adhered within the bore, or otherwise resides within the bore. The insert may dimensionally correspond to the shape of the first protruding nub 20. The bowling ball 100 likewise is equipped with a second bore 104 corresponding in size and shape to the second protruding nub 34, and a third bore 106 corresponding in size and shape to the third protruding nub 44. The second and third bores 104, 106 may also be created by boring a dimensionally corresponding bore as the second and third protruding nubs 34, 44, respectively. The bowling ball further includes the standard typical middle finger and ring finger holes 108, 110. These various openings may be custom-applied to the bowling ball in accordance with methods of the present invention shown in FIG. 7 and described herein below.

Figure 7:
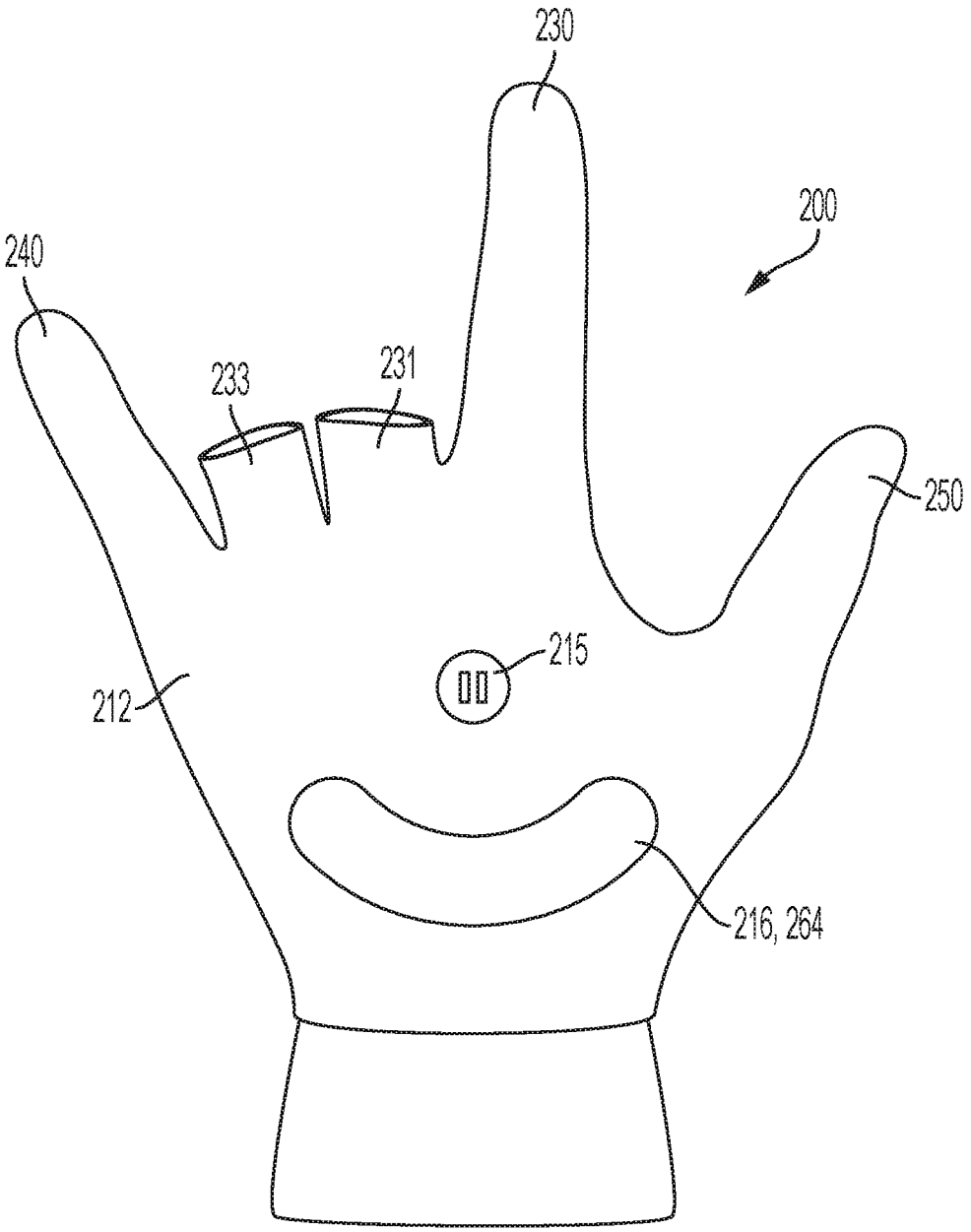
FIG. 7 depicts a perspective view of another bowling glove, in accordance with one embodiment.

FIG. 7 depicts a perspective view of another bowling glove 200, in accordance with one embodiment. The bowling glove 200 includes a glove body 212 having a palm portion 214. Extending from the palm portion 214 includes an index finger cover 230, a partial middle finger stall 231, a partial ring finger stall 233, a pinky finger cover 240 and a thumb cover 250. While the partial stalls 231, 233 are shown so that a bowler may expose the two fingers typically inserted into the finger holes of a bowling ball, it should be understood that the invention is not limited in this respect. In other contemplated embodiments, any of the finger locations may be partial stalls or full covers depending on the preference of a bowler without departing from the scope of the invention. Further, the thumb cover 250 is shown as a full cover in the embodiment shown. This may be particularly advantageous in embodiments where the bowling glove 10 is particularly configured for "no thumb" or "thumb out" bowling. While the bowling glove 200 does not include finger attachment locations on the pinky finger cover 240 and the index finger cover 230, other embodiments of the bowling glove 200 may incorporate this feature.

The bowling glove 200 differs from the bowling glove 10 described herein above in that the bowling glove 200 includes a different style nub attachment, such as one of the attachments 220A, 220B, 220C (shown in FIGS. 9A-9C). Further, the bowling glove 200 includes a different style support structure 260 (shown in FIG. 8) for receiving the nub attachment. However, various other features described hereinabove with respect to the bowling glove 10 may also be incorporated into the bowling glove 200, such as the straps wrapping around the glove body 212 and the like. The bowling glove 200 employs a support structure 260 having one or more screw bosses or female receivers configured to receive one of the exemplary nubs 220A, 200B or 220C, each having a threaded base.

Figure 8:
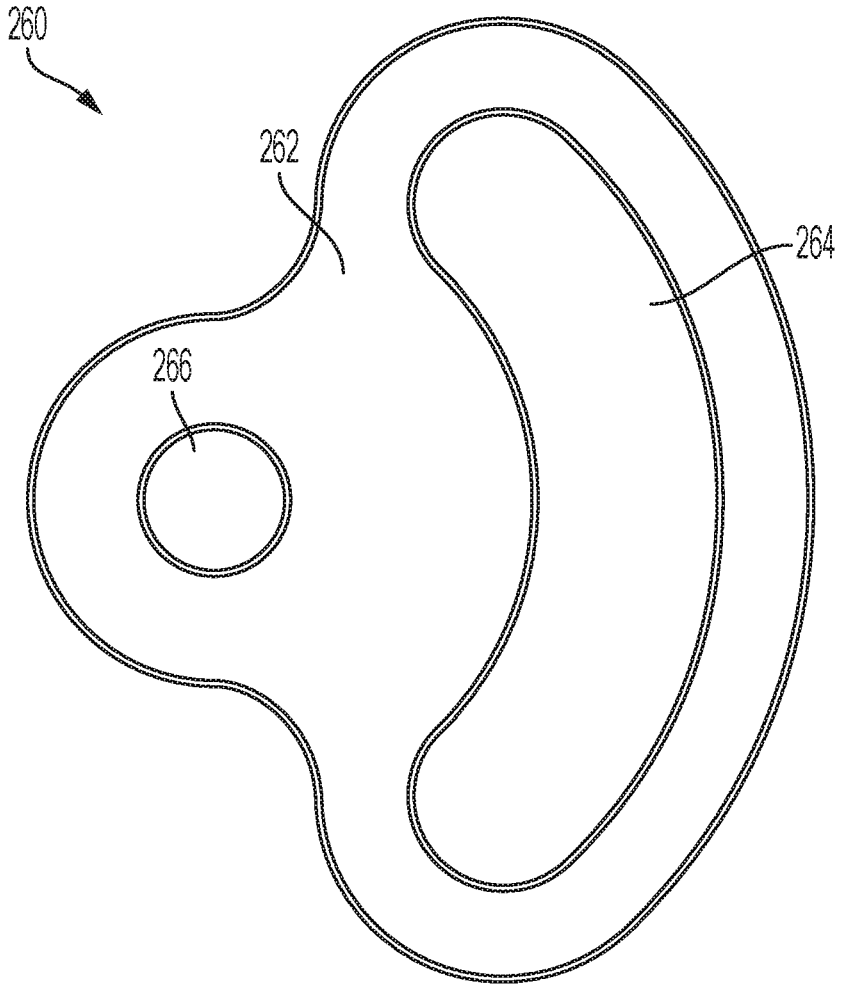
FIG. 8 depicts a perspective view of a support structure of the bowling glove of FIG. 7, in accordance with one embodiment.

FIG. 8 depicts a perspective view of a support structure 260 of the bowling glove 212 of FIG. 7, in accordance with one embodiment. The support structure 260 may allow the nub to be removably attachable to the glove body 212 in an adjustable manner. The support structure 260 includes a main body 262 that may be permanently affixable to the palm portion 214 of the glove body 212. For example, the support structure 260 may be sewn, glued, adhered or otherwise attached to the glove body 212 using any attachment means. The support structure 260 may include a pin opening 266 for receiving a pin structure 215 (shown in FIG. 7) that pins or otherwise facilitates attachment of the support structure 260 to the glove body 212. Like the support structure 60, the support structure 260 may be made of a material that is more rigid than the glove body 212. For example, the glove body 212 may be made of a fabric material, while the support structure 260 may be made of a plastic or composite material.

The support structure 260 is shown with a partial arc opening 264. The partial arc opening 264 may extend in a 90 degree arc to provide various locations on the palm portion 214 of the glove body 212 to receive one of the nubs 220A, 220B, 220C. This partial arc opening 264 may correspond to and align with a second partial arc opening 216 in the palm portion 214 of the glove body 212 (shown in FIG. 7) when the support structure 260 is attached to the glove body 212. The partial arc opening 264 of the support structure 260 may be configured to receive a threaded base of any of the protruding nubs 220A, 220B, 220C, described herein below. Specifically, the partial arc opening 264 may be configured to allow adjustability of an attached protruding nub 220A, 220B, 220C by sliding along the curved slot of the partial arc opening 264 until a desired position is reached. The support structure 260 may be rigid enough to provide structural support to retain the protruding nub 220A, 220B, 220C in place during use. However, the support structure 260 may also include a sufficient degree of flexibility to allow for the support structure to contour to the hand of a wear and flex during use in a manner that prevents discomfort while throwing.

Figure 9A:
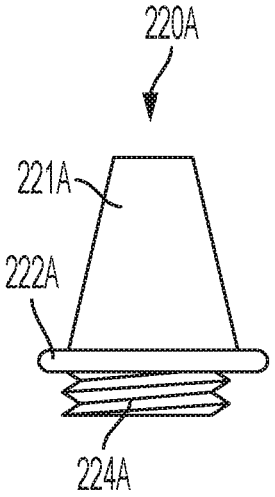
FIG. 9A depicts a perspective view of a nub body, in accordance with one embodiment.

FIG. 9A depicts a perspective view of a nub body 220A, in accordance with one embodiment. As shown, the nub body 220A includes a circular stop 222A from which an extending nub shape 221A extends on a top side, and a threaded base 224A extends below. The threaded base 224A may be configured to be insertable into the partial arc opening 264 via rotation for locking the nub body 220A in place within the partial arc opening 264. The extending nub shape 221A is shown to be a partial cone spike shape with a flattened top.

Figure 9B:
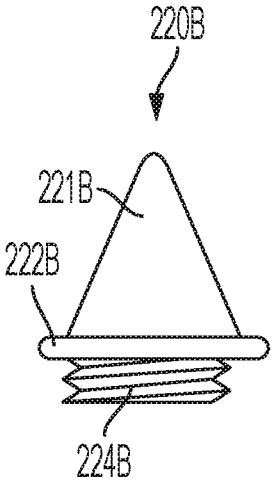
FIG. 9B depicts a perspective view of another nub body, in accordance with one embodiment.

FIG. 9B depicts a perspective view of another nub body 220B, in accordance with another embodiment. As shown, the nub body 220A includes a circular stop 222B from which an extending nub shape 221B extends on a top side, and a threaded base 224B extends below. The threaded base 224B may be configured to be insertable into the partial arc opening 264 via rotation for locking the nub body 220B in place within the partial arc opening 264. The extending nub shape 221B is shown to be a cone shape that extends to a pointed top.

Figure 9C:
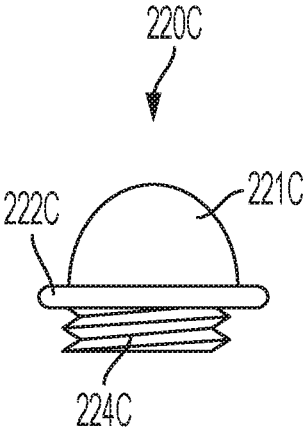
FIG. 9C depicts a perspective view of another nub body, in accordance with one embodiment.

FIG. 9C depicts a perspective view of another nub body 220C, in accordance with another embodiment. As shown, the nub body 220C includes a circular stop 222C from which an extending nub shape 221C extends on a top side, and a threaded base 224C extends below. The threaded base 224C may be configured to be insertable into the partial arc opening 264 via rotation for locking the nub body 220B in place within the partial arc opening 264. The extending nub shape 221C is shown to be a half spherical or otherwise rounded shape. The various nub shapes 221A, 221B, 221C are shown as exemplary but other shapes are contemplated without departing from the scope of the invention.

Figure 10:
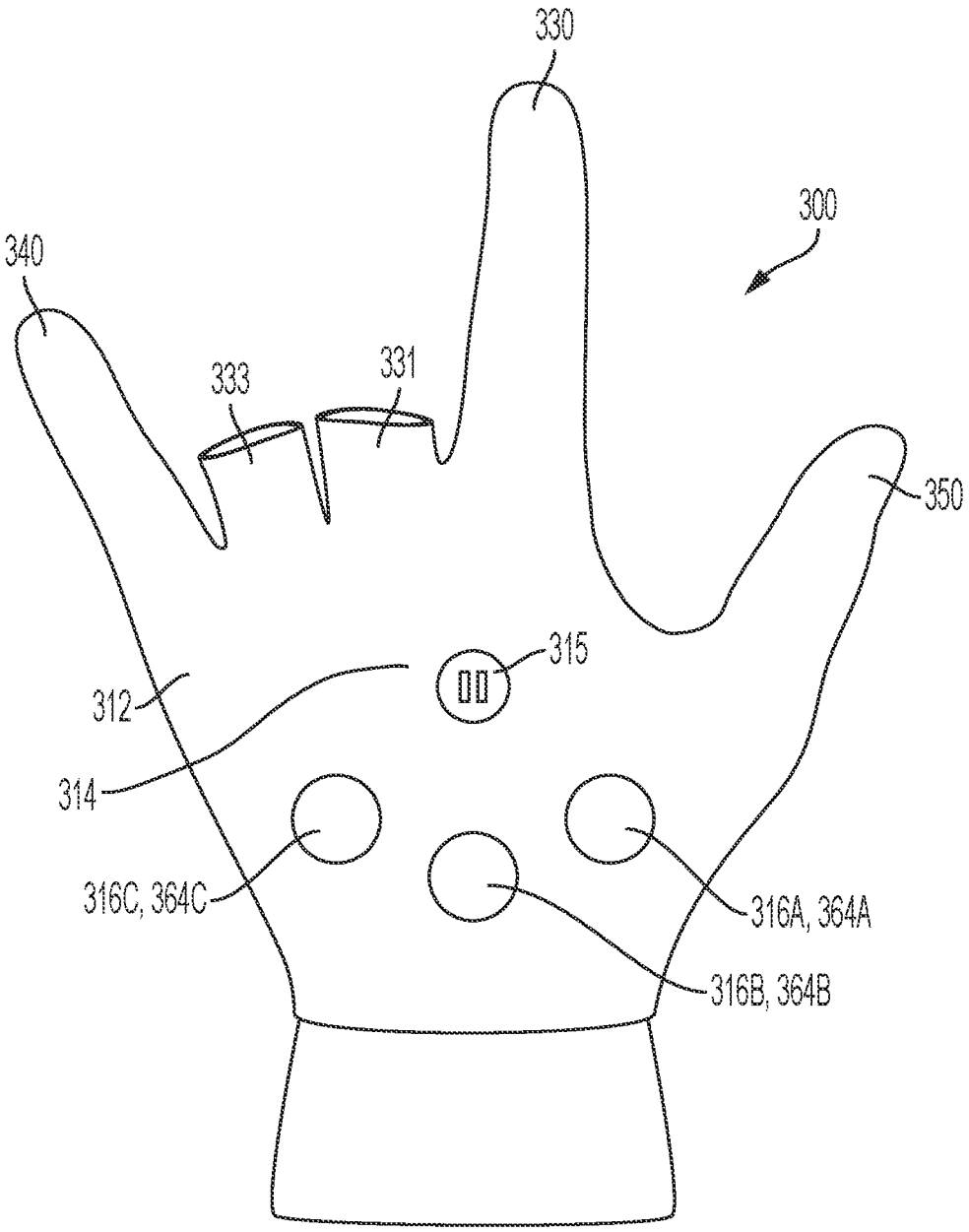
FIG. 10 depicts a perspective view of another bowling glove, in accordance with one embodiment.

FIG. 10 depicts a perspective view of another bowling glove 300, in accordance with one embodiment. The bowling glove 300 includes a glove body 312 having a palm portion 314. Extending from the palm portion 314 includes an index finger cover 330, a partial middle finger stall 331, a partial ring finger stall 333, a pinky finger cover 340 and a thumb cover 350. While the partial stalls 331, 333 are shown so that a bowler may expose the two fingers typically inserted into the finger holes of a bowling ball, it should be understood that the invention is not limited in this respect. In other contemplated embodiments, any of the finger locations may be partial stalls or full covers depending on the preference of a bowler without departing from the scope of the invention. Further, the thumb cover 350 is shown as a full cover in the embodiment shown. This may be particularly advantageous in embodiments where the bowling glove 10 is particularly configured for "no thumb" or "thumb out" bowling. While the bowling glove 300 does not include finger attachment locations on the pinky finger cover 340 and the index finger cover 330, other embodiments of the bowling glove 300 may incorporate this feature. The bowling glove 300 differs from the bowling glove 200 described herein above in that the bowling glove 300 includes a different style support structure 360 (shown in FIG. 11) for receiving the nub attachment. Specifically, the bowling glove 300 employs a support structure 360 having three separate screw bosses or female receivers, rather than the single partial arc opening 264, each configured to receive one of the exemplary nubs 220A, 220B or 220C.

Figure 11:
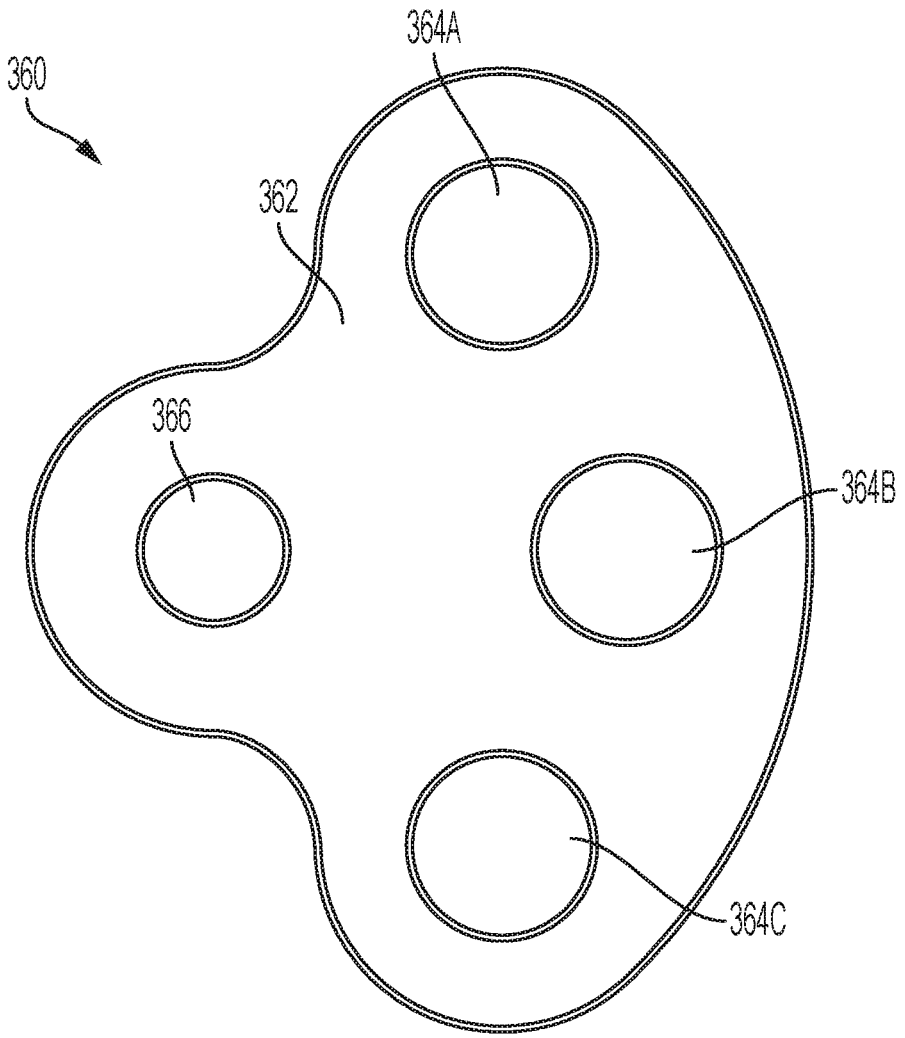
FIG. 11 depicts a perspective view of a support structure of the bowling glove of FIG. 10, in accordance with one embodiment.

FIG. 11 depicts a perspective view of a support structure 360 of the bowling glove 300 of FIG. 10, in accordance with one embodiment. The support structure 360 may have a plurality of attachment locations or screw bosses such that the nub may be removably attachable to the glove body 312 in an adjustable manner. The support structure 360 includes a main body 362 that may be permanently affixable to the palm portion 314 of the glove body 312. For example, the support structure 360 may be sewn, glued, adhered or otherwise attached to the glove body 312 using any attachment means. The support structure 360 may include a pin opening 366 for receiving a pin structure 315 (shown in FIG. 10) that pins or otherwise facilitates attachment of the support structure 360 to the glove body 312. Like the support structure 60, the support structure 360 may be made of a material that is more rigid than the glove body 312. For example, the glove body 312 may be made of a fabric material, while the support structure 360 may be made of a plastic or composite material.

The support structure 360 is shown with a plurality of threaded boss openings 364A, 364B, and 364C. The threaded boss openings 364A, 364B, 364C may provide three different locations on the palm portion 314 of the glove body 312 to receive one of the nubs 220A, 220B, 220C. These threaded boss openings 364A, 364B, 364C may correspond to and align with a partial arc openings 316A, 316B, 316B in the palm portion 314 of the glove body 312 (shown in FIG. 10) when the support structure 360 is attached to the glove body 312. Each of the threaded boss openings 364A, 364B, 364C of the support structure 360 may be configured to receive a threaded base of any of the protruding nubs 220A, 220B, 220C, described herein above. This may provide for removable adjustability of a protruding nub at various locations on the glove body 312. Locations are not limited to the embodiment shown, and some embodiments may include a support structure 360 having openings at different locations on the palm portion 314 of the glove body 312. The support structure 360 may be rigid enough to provide structural support to retain the protruding nub 220A, 220B, 220C in place during use. However, the support structure 360 may also include a sufficient degree of flexibility to allow for the support structure to contour to the hand of a wear and flex during use in a manner that prevents discomfort while throwing.

Further contemplated are methods of manufacturing a bowling glove, such as the bowling glove 10. Methods include a first step of providing a glove body including a palm portion configured to cover a palm of a wearer. Methods include a second step 220 of creating a plurality of palm attachment locations in the palm portion. The creation of the plurality of palm attachment locations may include creating a plurality of openings in the palm portion of the glove body. Further, the creation of the plurality of palm attachment locations may include reinforcing the stitching in the openings, applying additional material surrounding each opening, or attaching a patch of material in the palm portion that includes the openings pre-stitched therein, where the patch of material includes a more durable material than the rest of the glove body.

Methods may include another step of affixing a support structure to the palm portion of the glove body, the support structure having a rigidity greater than the glove body, the support structure including at least one opening. The step may include stitching, adhering, or otherwise attaching the support structure to the glove body. In one embodiment, the step may include disposing the support structure between two layers of fabric stitched together in the shape of the support structure to retain the support structure in position.

The affixing the support structure may be completed such that the at least one opening aligns with one or more of the plurality of openings of the palm portion of the glove body. Thus, the method may include a step of aligning the at least one opening with at least one of the plurality of attachment locations of the palm portion of the glove body, the at least one opening configured to receive a threaded peg. The method may include another step of fashioning a protruding nub securably attachable to the palm portion of the glove body at each of the plurality of palm attachment locations such that the location of the protruding nub relative to the palm portion of the glove body is selectively adjustable. The step may be accomplished such that the protruding nub is configured to protrude from the palm portion of the glove body, and wherein the protruding nub is configured to be received by a bore of a bowling ball. The fashioning of the protruding nub may include fashioning a base portion having a threaded peg extending therefrom. The fashioning of the protruding nub may further include fashioning a nub body having a threaded hole that is attachable to the threaded peg by engaging the threaded peg within the threaded hole of the nub body.

While not shown, the method may include additional steps of creating a plurality of finger attachment locations in one or more finger portions of the glove body. The method 200 may further include affixing additional support structures proximate these finger attachment locations.

Further contemplated are methods of fitting a bowling ball to a bowling glove in accordance with one embodiment. The method includes a first step of providing a bowling glove, such as the bowling glove 10. The method includes a step of providing a bowling ball having a spherical outer surface, such as the bowling ball 100. The method includes a step of determining a location on the spherical outer surface for drilling a bore configured to receive the protruding nub. The determining may include applying a marking color to a tip surface of the protruding nub and having a wearer hold the bowling ball in a desired position in order to press the tip surface of the protruding nub against the bowling ball to mark the appropriate location for drilling a bore. The method includes a further step of drilling the hole configured to receive the protruding nub, the dimensions of the bore corresponding to the dimensions of the protruding nub. Step may include dimensioning the bore to be slightly larger than the dimensions of the protruding nub such that the bore is configured to receive the protruding nub in a snug manner, but maintains the allowance of the nub to easily release from the bore when the ball is thrown. The dimensioning the bore may include boring the bore using a tool that corresponds to the shape of the protruding nub of the bowling glove.

The method includes an optional step of determining a location on the spherical outer surface for drilling a second and/or third bore configured to receive a second and/or third protruding nub corresponding to finger nub for the pointer and pinky fingers. The method includes another optional step of drilling the second and/or third bore configured to receive the second and/or third protruding nub, the dimensions of the second and/or third bore corresponding to the dimensions of the second and/or third protruding nubs, respectively. The method may alternatively include boring the bowling ball using standard bore sizes and the modifying the bore sizes with an insert that is adhered, attached, connected or otherwise resides within the bore. The insert may modify the bore dimensions such that the bore dimensions correspond to the shape of the protruding nub that corresponds to the bore on the bowling glove.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. A bowling glove comprising:

a glove body including a palm portion configured to cover a palm of a wearer;

a support structure permanently affixed to the palm portion of the glove body, the support structure having a rigidity greater than the glove body, the support structure further having a plurality of openings; and a protruding nub securably attachable to the palm portion of the glove body such that the location of the protruding nub relative to the palm portion of the glove body is selectively changeable, wherein the protruding nub is configured to protrude from the palm portion of the glove body, and wherein the protruding nub is configured to be received by a bore of a bowling ball, wherein the palm portion includes a plurality of apertures, and wherein the plurality of apertures are each located at a heel of the palm portion, and wherein the plurality of openings of the support structure correspond to and align with the plurality of apertures of the palm portion of the glove body, and wherein the protruding nub is selectively attachable to each of the plurality of openings of the support structure at each of the plurality of apertures.

2. The bowling glove of claim 1, wherein the support structure is layered between the palm portion of the glove body and an inner layer, the inner layer configured to touch the skin of the wearer.

3. The bowling glove of claim 2, wherein the palm portion at least partially includes a material configured to grip an outer surface of the bowling ball, and wherein the inner layer includes a material that is soft to touch.

4. The bowling glove of claim 1, wherein the glove 1, wherein each of the plurality of apertures in the glove body are structurally reinforced with at least one of reinforced stitching, additional material, or a different material.

5. The bowling glove of claim 1, wherein each of the plurality of apertures in the glove body are structurally reinforced with at least one of reinforced stitching, additional material, or a different material.

6. The bowling glove of claim 1, wherein the protruding nub is selectively attachable to each of the plurality of openings of the support structure at each of the plurality of apertures.

7. The bowling glove of claim 6, wherein the protruding nub includes external threads configured to engage internal threads within the plurality of openings.

8. The bowling glove of claim 1, wherein the nub body includes a stop from which an extending nub shape extends on a top side and a threaded base extends below.

9. The bowling glove of claim 8, wherein the extending nub shape is a partial cone spike shape with a flattened top.

10. The bowling glove of claim 8, wherein the extending nub shape is a cone shape that extends to a pointed top.

11. The bowling glove of claim 8, wherein the extending nub shape is a rounded shape.

12. A method of manufacturing a bowling glove comprising: providing a glove body including a palm portion configured to cover a palm of a wearer, the palm portion including at least one palm attachment location;

aligning the at least one opening with at least one of the plurality of attachment locations of the palm portion of the glove body, the at least one opening configured to receive a threaded peg; and fashioning a protruding nub securably attachable to the palm portion of the glove body at the at least one palm attachment location such that the location of the protruding nub relative to the palm portion of the glove body is selectively adjustable, wherein the protruding nub is configured to protrude from the palm portion of the glove body, and wherein the protruding nub is configured to be received by a bore of a bowling ball.

13. The method of claim 12, wherein the at least one palm attachment location is a plurality of attachment locations, the method further comprising: affixing a support structure to the palm portion of the glove body, the support structure having a rigidity greater than the glove body, the support structure including at least one opening.

* * * * *